United States Patent [19]

Ackerman et al.

[11] 4,446,906

[45] May 8, 1984

[54] METHOD OF MAKING A CAST ALUMINUM BASED ENGINE BLOCK

[75] Inventors: Allen D. Ackerman, Troy; Howard A. Aula, Dearborn Hgts., both of Mich.

[73] Assignee: Ford Motor Company, Dearborn, Mich.

[21] Appl. No.: 206,430

[22] Filed: Nov. 13, 1980

[51] Int. Cl.[3] ..... B22D 19/00

[52] U.S. Cl. ..... 164/112; 164/132

[58] Field of Search ..... 164/132, 522, 103, 105, 164/366, 367, 368, 112, 137, 529, 332, 333

[56] References Cited

U.S. PATENT DOCUMENTS

| | | | |
|---|---|---|---|
| 2,681,054 | 6/1954 | Boghossian . | |
| 2,858,262 | 10/1958 | Plott | 164/112 |
| 2,974,654 | 3/1961 | Bouvy . | |
| 3,166,992 | 1/1965 | Francis . | |
| 3,264,693 | 8/1966 | Flitz | 164/368 |
| 3,311,956 | 4/1967 | Townsend . | |
| 3,356,129 | 12/1967 | Anderko | 164/36 |
| 3,485,290 | 12/1969 | Campbell | 164/100 |
| 4,003,422 | 1/1977 | Schramm | 164/112 |
| 4,093,018 | 6/1978 | Trumbauer | 164/34 |

FOREIGN PATENT DOCUMENTS

| | | | |
|---|---|---|---|
| 1933867 | 3/1968 | Fed. Rep. of Germany | 164/112 |
| 4817 | 2/1971 | Japan | 164/522 |

*Primary Examiner*—Kuang Y. Lin
*Assistant Examiner*—Richard K. Seidel
*Attorney, Agent, or Firm*—Joseph W. Malleck; Olin B. Johnson

[57] ABSTRACT

A method of making a die cast aluminum based engine block with a closed deck is disclosed. A core assembly having at least one water soluble alkaline metal salt core member is stationed on a bore die of a die casting assembly for the block. The core assembly also preferably comprises an iron cylindrical liner centered within the salt core member by an aluminum mesh collar which dissolves in the cast metal during high pressure aluminum die casting. The salt core member is fabricated by die casting under pressure and heat to form a shaped body which, as a core, cooperated to define a substantially closed chamber to serve as the water jacket for the block. The salt core member is removed from the cast block by water dissolution admitted through small port openings in the closed deck block to form a brine, which brine is then washed out of such port openings.

6 Claims, 5 Drawing Figures

METHOD OF MAKING A CAST ALUMINUM BASED ENGINE BLOCK

BACKGROUND OF THE INVENTION

Cast engine blocks can be classified into two basic styles, closed or open deck constructions, the deck being the block surface upon which is mounted the engine head for closing the combustion chambers of the engine. A closed deck is one where the interior chambers of the block, such as water passages, do not interrupt the deck surface except for small transfer or circulation ports. An open deck is one where the die forming members for the cylinder walls and water jacket must penetrate the plane of the deck to shape the interior spaces of the cast object. The need for allowing the dies to enter and be withdrawn through the deck surface prohibits the use of undercut surfaces and, of course, dictates that the area of the deck through which the dies pass must remain open.

Most engine blocks heretofore have been made as closed deck designs, the blocks being cast in sand molds by gravity pouring methods using molten grey iron as the castable material. The benefits of a closed deck design include: (a) greater stability against thermal deformation during engine use, and (b) more accurate wall definition during casting. Internal chambers for a water jacket adjacent the engine cylinders are usually defined by totally enclosed sand cores bonded by chemically cured or heat cured resins. The sand grains are removed from the closed type of casting structure by use of vibration or impact forces which disintegrate the sand core (which has become more brittle by the heat of casting). Such closed deck designs have worked well because (a) the use of iron as the castable material makes the sand cores brittle and thereby easy to remove, and (b) the use of little or no pressure on the casting medium and thus little or no pressure on the cores employed.

With the advent of lighter engine blocks and the need for higher productivity, engine designers are turning to high pressure die casting for the casting of aluminum blocks. Such blocks have been made as open deck designs because of the inherent requirement for withdrawal of the permanent dies from the casting cavity. One of the concerns of the present invention is to provide the benefits of a closed deck engine block design, but fabricated by the use of high pressure die casting techniques.

SUMMARY OF THE INVENTION

The invention is a method of making a die cast aluminum based engine block having a closed deck. First, a core assembly having at least a water soluble alkaline metal salt core member is stationed on a die of a die casting assembly, the latter being arranged to provide a cavity defining a closed deck block. The core member is designed to form a predetermined chamber in the resulting casting. The salt core member is fabricated by die casting under pressure and heat to form a shaped body which, as a core, cooperates to define the chamber. The core member also has structural means to reserve port openings through the deck of the resulting casting; preferably this comprises integral extensions on the core member to define core prints. Secondly, molten aluminum based metal is introduced under pressure into the cavity to fill same and to form the block with the enclosed core. Lastly, the core is removed from the solidified block by water dissolution, the water being admitted to the chamber through the port openings and the dissolved salt being withdrawn also through the port openings.

The salt core is preferably comprised of 70% KCL and 30% of at least one of $SiO_2$ and $Al_2O_3$; the core assembly is preferably preheated to a temperature of 400°-500° F. prior to stationing within the die casting assembly. An advantageous application of the invention comprises shaping the salt core member as a hollow core cylinder, and then spacing a cylindrical metal liner radially inwardly of the salt core. A resilient low melting mesh collar is interposed between the core and liner to stabilize, support and center the liner with respect to the core, the collar being disintegratable by the heat of the molten metal when introduced into the cavity. The mixture for the core is preferably die cast under a pressure of about 10,000 to 15,000 psi, at a temperature of about 1450°-1700° F. The core resulting from such preferred chemistry and processing will have tensile strength of 150-175 psi, a compressive strength of 10,000-15,000 psi, and will have the physical characteristics necessary to withstand the molten metal impingement imposed during high pressure die casting.

DETAILED DESCRIPTION OF THE INVENTION

Figure 1:
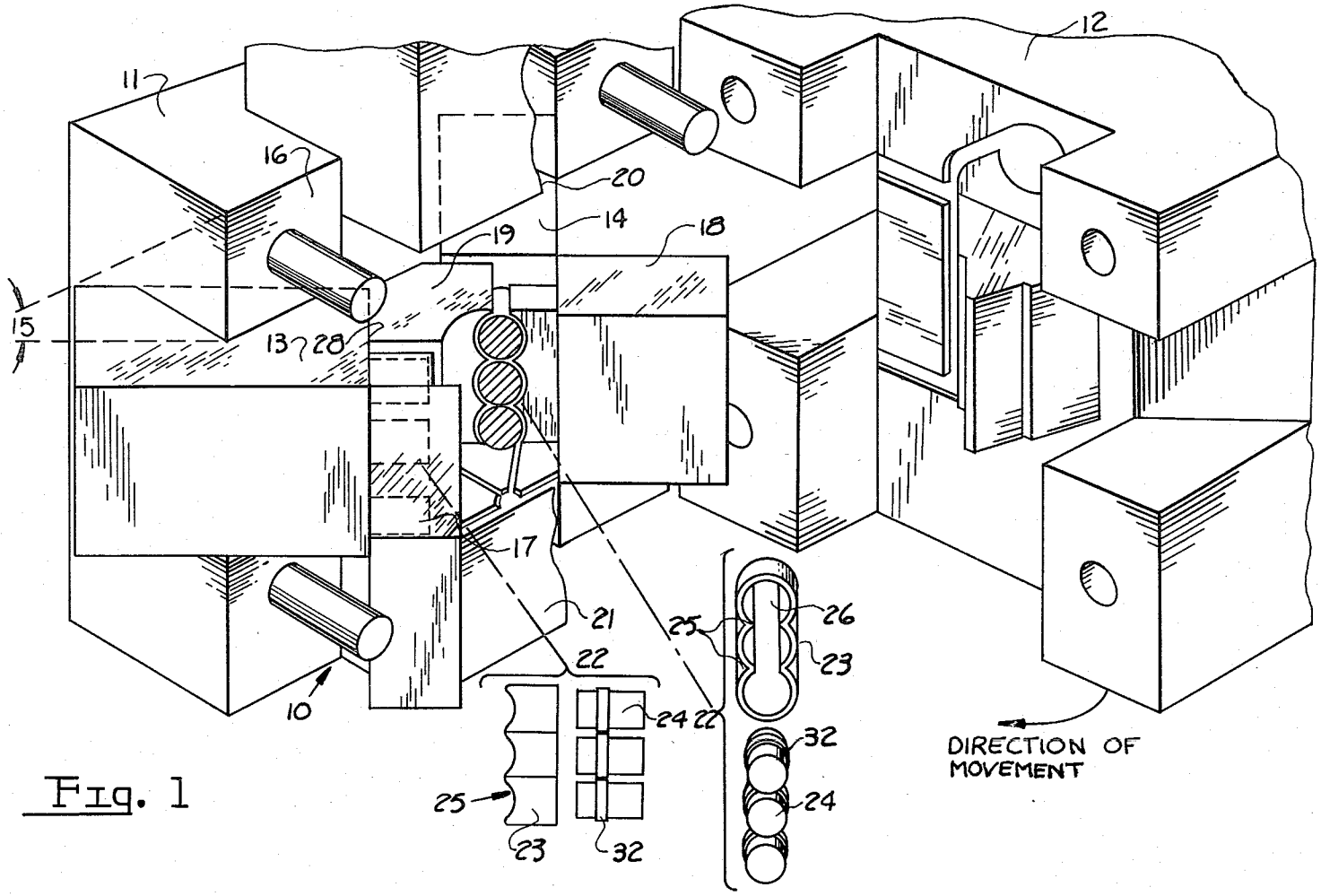
FIG. 1 is an exploded perspective view of a high pressure die casting assembly having eight permanent die members for defining a closed deck engine block; a water soluble salt core assembly is also shown as adapted to be planted on one of the barrel dies to define an enclosed chamber in the resulting casting.
Figure 5:
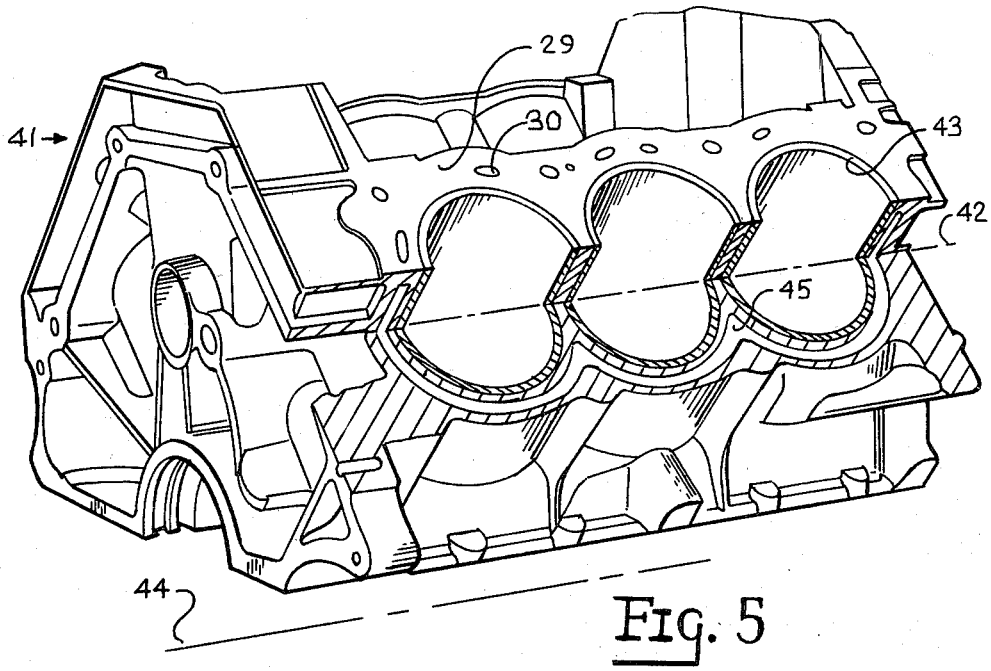
FIG. 5 is a perspective view of the casting resulting from using the die assembly illustrated in FIG. 1.
Figure 2:
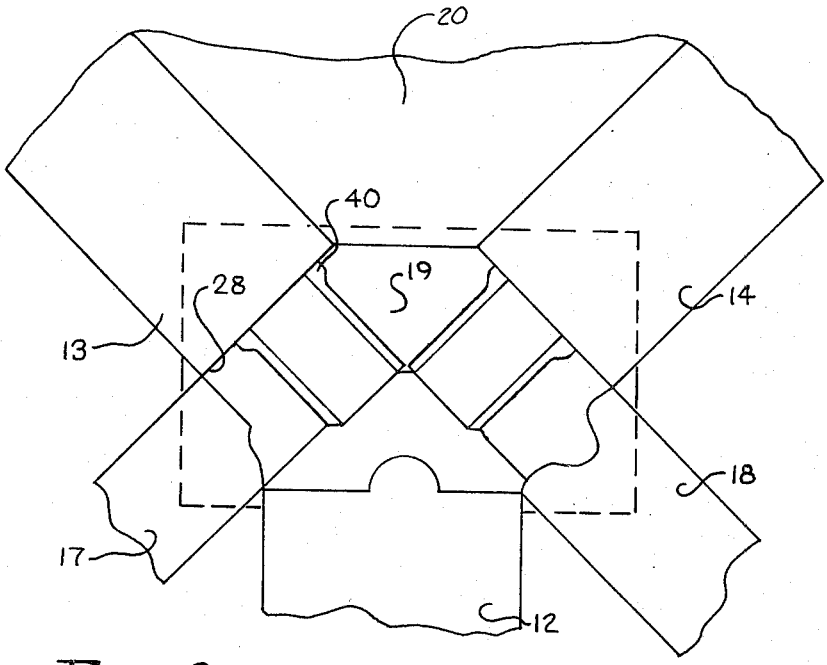
FIG. 2 is a plan view of the apparatus in FIG. 1 in the closed die position (some portions of the apparatus being shown in cross-section)
Figure 3:
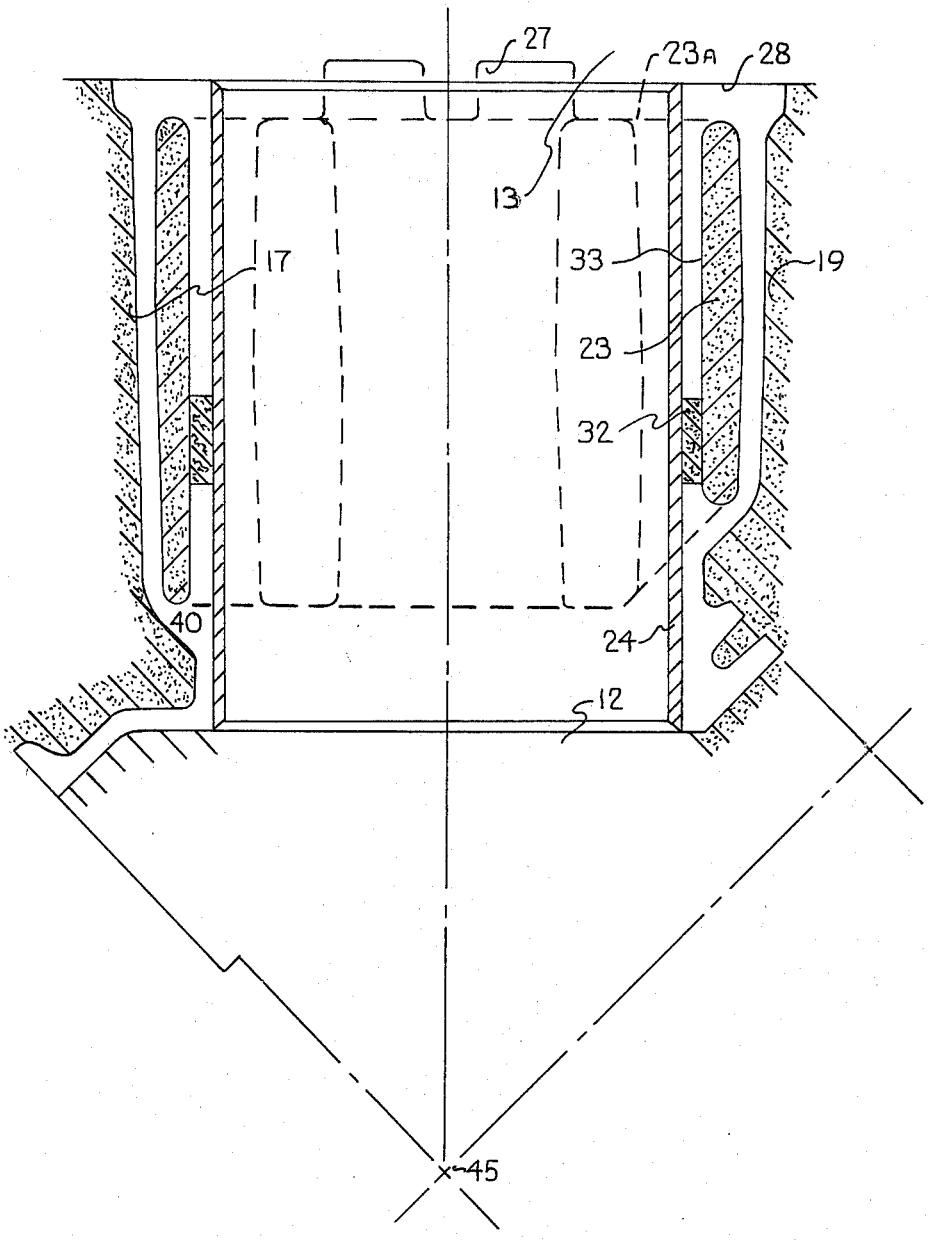
FIG. 3 is an enlarged sectional view of a portion of the die casting assembly used in FIG. 1 having the core assembly planted therein.

A preferred mode for making a die cast aluminum based engine block is illustrated in FIGS. 1-3. The preferred product is a six cylinder V-shaped block 41 having two rows 42 of three in-line cylinders 43 angularly spaced apart about the crankshaft axis 44 (see FIG. 5). For this mode and product, a die casting assembly 10 (FIG. 1) is employed which is comprised of eight permanent die components, six of which are movable into position by a suitable hydraulic mechanism associated with each die component. When brought together, the die components define a cavity 40 for the block having an enclosed water jacket chamber 45. The fixed die components comprise a base ejector die component 11 upon which are movably mounted the six movable die components and a cover die component 12. The base ejector die and the cover die extend in a vertical plane, the cover die being moved laterally to mate with the ejector die and close the block cavity.

To define the interior and bottom of each row of cylinders, bore die components 13 and 14 are used, each of which is movably mounted on the ejector die component. The bore die components are moved horizontally inwardly at an angle 15 to the plane 16 of the ejector die component. Side die components 17 and 18 are moved horizontally and perpendicular to the direction of the bore die to define the side contours of the block. The ejector die, being fixed, carries a die face 19 for defining certain bottom portions of the block. The ends of the block are defined by movable die components 20 and 21, each movable along a vertical axis.

I. The first step of the process for making the engine block is to station a core assembly 22 (having a water soluble alkaline metal salt core member 23) on a permanent die of the die casting assembly (here being the bore die components 13 or 14). Such core assembly is comprised of a water soluble salt core member 23 which forms at least one hollow cylinder, but preferably a series of connected cylinders defined by a continuous band undulating in series along and spaced from the outer periphery of the series of in-line iron liners 24 (the latter forming the combustion chambers). The core 23 provides a partial sleeve about each of the liners 24, the partial sleeves being joined together in siamese fashion at 25 with the complete connection between each sleeve being interrupted at 26. The core here is used to define an enclosed chamber 45 in the engine block which will serve as a water jacket for cooling the engine.

The salt core is preferably comprised of a composite material consisting essentially of a fine particulate dispersion in a brittle salt matrix. The dispersion serves as a strengthening ingredient by acting as a particle block to cracks attempting to propogate through the matrix. The composite material is preferably fabricated by mixing 70% KCl (as the matrix) and 30% of at least one of $Al_2O_3$ and $SiO_2$ (as dispersion agent). The matrix material can also be other materials such as NaCl which maintains integrity during aluminum casting, is economical and readily available, has a good dissolution removal characteristic, and is not unduly hygroscopic. KCl is preferred because it also has a high solubility per unit water and, because solubility is temperature dependent, the salt can be more easily reclaimed from brine generated in core removal operations. The dispersion agent can be any fine particulate which does not melt at or below the superheat temperature of the matrix material; it is desirable to choose a dispersion agent that has a density close to the density of the molten matrix so that a homogeneous suspension can be obtained.

Due to a solidification shrinkage of about 18% the KCl base core material must be die cast and solidified under high pressure to insure a strong, dense core material of the desired configuration. The die casting conditions for such salt core should be at a temperature of about 1450°-1700° F., under a pressure of about 10,000-15,000 psi. The solidification time experienced for a water jacket core, of the size illustrated, was about 20 seconds (a range of 15-100 seconds being usually satisfactory). A core cast in this manner will have a compressive strength of 10,000-15,000 psi, at least 12,000 psi when the preferred mixture is employed, a tensile strength of 150-175 psi, and will have sufficient thermal shock resistance to provide coring in a high pressure die casting such as a V-6 engine block.

To stabilize the salt core within the cavity 40 defined by the die casting assembly, the salt core has protuberances 27 or means which extend from the upper edge **23*a* of the core sleeve to engage complimentary openings in the shoulder 28 of the bore die components. The protuberances act as core prints which reserve access ports 30 in the closed deck 29 of the final casting (see FIG. 5). These proturberances are important because the core, in its prepositioned or stationing condition within the die cavity, is spaced from die walls such as liners 24 and the ejector die 13 or 14. The protuberances preferably are cylindrical shaped extensions from the upper edge of the core body having a thickness less than the thickness of the core body wall. Although such protuberances provide good axial positioning and some radial (centering) positioning about the liners, it is preferable to employ a mesh collar 32 to optimize such positioning. The collar is constructed of knitted aluminum (wire mesh) fabric rolled into a continuous collar fitting snuggly within one of the core interior cylinder surfaces 33 and snuggly about the ferrous liners 24**. The fabric should be of a low melting metal (comparable to the metal to be cast) such that upon casting, the heat of the molten metal will dissolve the collar. The collar will not dissolve immediately upon contact by the molten metal, but will survive for a few seconds to stabilize the core and liner against movement by the injected molten metal.

Figure 4:
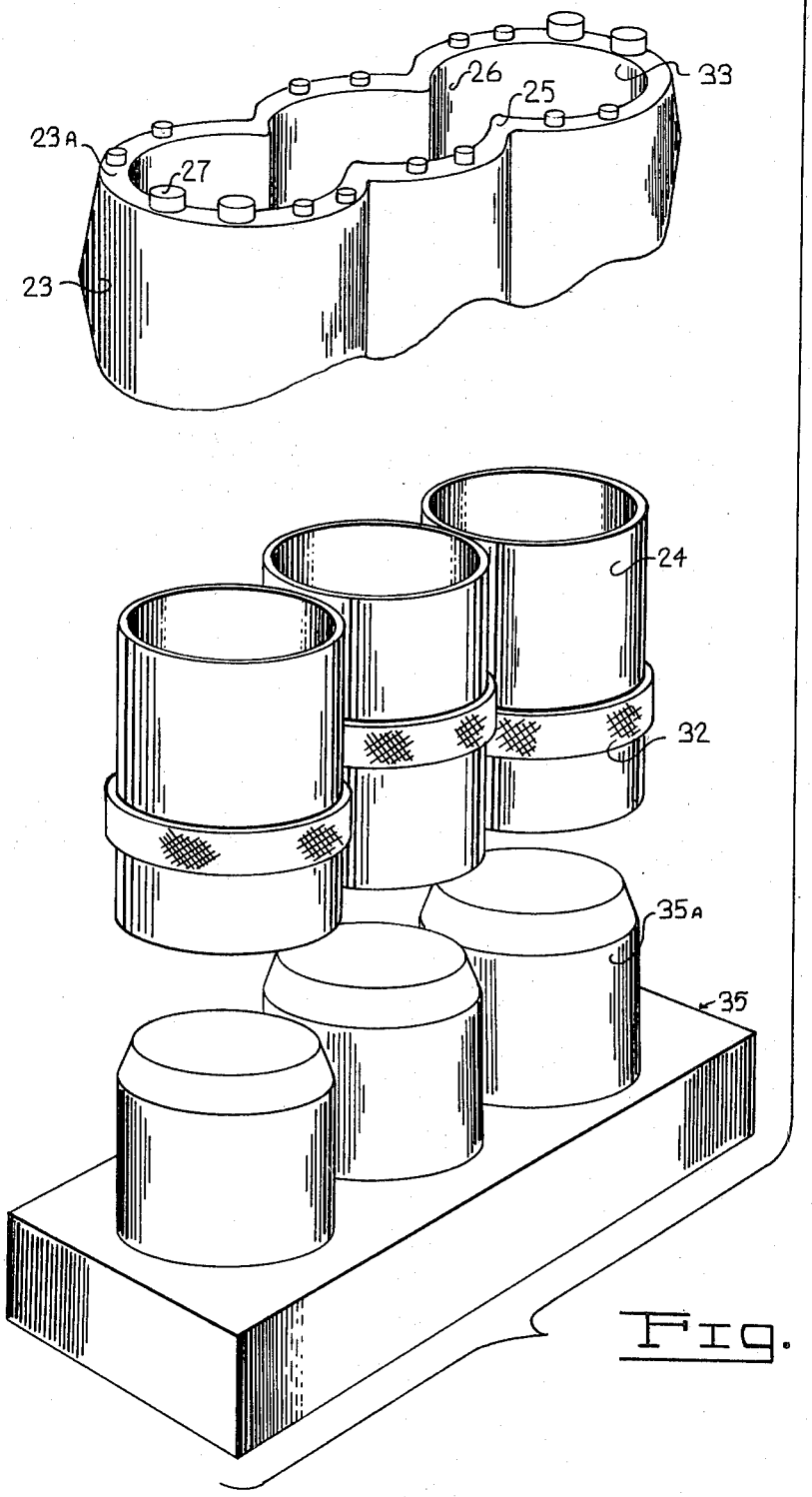
FIG. 4 is an enlarged exploded view of the core assembly ready for stationing on a preheating apparatus.

To ensure that the core assembly does not promote premature chill of the injected molten metal, it is preheated in an oven constructed from an insulated steel drum equipped with a manually operated carousel of shelves. The gas fired oven is designed to raise the temperature of the core to a range of 550°-650° F. To facilitate heating of the core assembly, a fixture 35 is employed, as illustrated in FIG. 4. The fixture 35 has a surface **35*a*** shaped to the interior of the die cast salt core. The core, liner and collar, when placed thereon, will be heated to the temperature range of 550°-650° F. The core assembly is preferably carried by a robot, when properly heated, to be stationed on the barrels of the bore die component. The movable die components are then moved to close the block cavity, readying the assembly for injection casting.

II. The second step of the process requires that molten aluminum based metal be introduced under pressure into the cavity 40 to fill same and to form the engine block, with the enclosed chamber 45 defined by the core. High casting pressures of relatively high values are needed to fill a cavity of the size and complexity here involved, typically 15,000-20,000 psi. The dwell time for holding such pressure varies for each product, and was about 40 seconds for this block. Solidification takes place rapidly, within 0.001 seconds at the casting skin, and within 40 seconds in the core region of the casting.

III. The last step involves removal of the core material by water dissolution. Water, preferably warm water of about 200° F., is admitted into the chamber 45 to dissolve the salt material. This can be carried out by immersing the casting in a water bath for 30 minutes. The bath water enters the chamber 45 through port openings 30 defined by the core prints 27.

One specific test of the above method comprised making the core utilizing 70% KCl and 30% $Al_2O_3$; a charge of 10-15 lbs. of this material was added to a 60 lb. capacity gas fired crucible melter. When approximately half of the initially charged core material was melted, additional amounts were metered into the furnace. This was continued until all of the mixture was melted at about 1450° F. The molten mixture was then superheated to 1550°-1600° F. Just prior to casting of the core, the material was vigorously stirred to ensure homogeniety, such as by a submerged agitation propeller. Homogeniety is important to achieve the proper physical characteristics in the core.

The molten mixture was then hand-ladled into a shot sleeve of a 600 ton die casting machine. The molten mixture of salt and particulate was then injected into the die cavity (for forming an engine block water jacket) and solidified under a pressure of approximately 10,000 psi. The dwell time (during which the die is closed and pressure applied) was adjusted to the core section size, here being 20 seconds. Additional cores were cast by repeating the sequence using a light silicone/water base lubricant spray on the die faces between shots. The cast runners and shot biscuits were returned directly to the furnace.

The block was cast by melting a charge of 380 aluminum alloy containing nominally 3.5% Cu, 8.5% Si, and the remainder aluminum. The molten aluminum alloy, held at a temperature of 1225° F., was then ladled into the shot sleeve of a 2500 ton die cast machine shown in FIG. 1; prior to casting the die cast machine was prepared by automatic planting of the preheated core assembly (cast iron liners, aluminum mesh collars and salt core) onto the bore die components. The molten aluminum alloy was injected into the block cavity under a pressure of 12,000 psi, and solidified under a dwell time of 40 seconds. The die was then opened, casting removed, and runners and scrap metal trimmed therefrom. The casting was then subjected to warm pressurized water to dissolve the salt core and particulate. The water waste from this operation was then processed to reclaim the salt mixture preferably by flash cooling or by an evaporative process. The resulting reclaimed brine was then subjected to a centrifuge for drying and returned to be used for core making.

I claim:

1. A method of making a cast aluminum based engine block having one or more combustion chambers, the method comprising:

(a) stationing a core assembly in a die casting assembly which is effective to provide a cavity when the assembly is closed to define a closed-deck block, said die casting assembly having means to reserve port openings and combustion chambers through the deck of the closed-deck block, said core assembly having a water soluble alkaline metal salt member selected from the group of KCl and NaCl, formed by die casting under pressure and heated to a shaped body effective to define in cooperation with said die casting assembly a submerged cast chamber, said salt member having at least one hollow cylindrical portion arranged to wrap about in spaced relation thereto one or more of said means to reserve combustion chambers, said core assembly also having a cylindrical iron liner spaced radially inwardly from said salt member and adapted to fit snugly about a portion of said means of said die casting assembly, and a resilient low melting metal mesh collar interposed between said core and liner to stabilize, support and center said liner on said core, said collar dissolved after the molten metal has been introduced into said cavity and is in place;

(b) introducing molten aluminum based metal under pressure into said cavity to fill same and to form said block having said chamber; and (c) removing said salt member from said cast block by water dissolution, water being admitted to said chamber through said port openings and the dissolved salt member being withdrawn through said port openings.

2. The method as in claim 1, in which said engine block has a plurality of combustion chambers and said salt member is shaped to define a continuous band undulating in series along but spaced from the outer peripheries of said means to reserve said combustion chambers without extending therebetween.

3. The method as in claim 1, in which said salt member is formed so as to have the following physical characteristics: a compressive strength of at least 10,000 psi, a tensile strength of at least 150 psi, and a thermal shock resistance value effective to withstand the temperatures and pressure in a high pressure die casting operation of molten metal.

4. The method as in claim 1, in which said salt member is comprised of 70% potassium chloride, 30% of at least one of $SiO_2$ and $Al_2O_3$, said mixture being pressed at a pressure of about 10,000–15,000 psi in a closed die while heated to the temperature of 1450°–1700° F.

5. A method of making a die cast aluminum based engine block in a mold having mold walls defining a casting cavity, the method comprising:

(a) implanting an assembly into said cavity to provide for a predetermined enclosed chamber in the resulting casting, said assembly comprising at least one cylindrical ferrous liner adapted to form an integral exposed surface of the casting, a water soluble alkaline metal salt based core defining substantially the shape of said predetermined chamber, and a low melting mesh collar interposed between said liner and core to resiliently hold at least a portion of said core uniformly spaced from said liner during step (b); and (b) introducing pressurized molten aluminum based metal into said cavity to fill same and to dissolve said collar, which filling of said cavity forms a wall between said liner and core with a predetermined thickness governed by said collar.

6. The method as in claim 5, in which said collar is effective to center and stabilize said liner concentrically and axially within said core against forces experienced during casting.

* * * * *